US007635019B2

(12) United States Patent
Higashiyama

(10) Patent No.: US 7,635,019 B2
(45) Date of Patent: Dec. 22, 2009

(54) HEAT EXCHANGER

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 290 days.

(21) Appl. No.: 11/571,938

(22) PCT Filed: Jul. 15, 2005

(86) PCT No.: PCT/JP2005/013530

§ 371 (c)(1),
(2), (4) Date: Jan. 11, 2007

(87) PCT Pub. No.: WO2006/006744

PCT Pub. Date: Jan. 19, 2006

(65) Prior Publication Data

US 2008/0028788 A1 Feb. 7, 2008

Related U.S. Application Data

(60) Provisional application No. 60/588,985, filed on Jul. 20, 2004, provisional application No. 60/688,327, filed on Jun. 8, 2005.

(30) Foreign Application Priority Data

Jul. 15, 2004 (JP) ..... 2004-208241
Oct. 13, 2004 (JP) ..... 2004-298283

(51) Int. Cl.
*F28D 1/053* (2006.01)

(52) U.S. Cl. ..... 165/110; 165/153; 165/176; 165/DIG. 198

(58) Field of Classification Search ..... 165/158, 165/152, 153, 176, 913, DIG. 195, DIG. 198, 165/110; 62/515
See application file for complete search history.

(56) References Cited

U.S. PATENT DOCUMENTS 677,876 A * 7/1901 Martin ..... 165/144

(Continued)

FOREIGN PATENT DOCUMENTS

JP 4 363592 12/1992

(Continued)

OTHER PUBLICATIONS

U.S. Appl. No. 11/571,364, filed Dec. 28, 2006, Higashiyama et al.

*Primary Examiner*—Teresa J Walberg
(74) *Attorney, Agent, or Firm*—Oblon, Spivak, McClelland, Maier & Neustadt, L.L.P.

(57) ABSTRACT

An evaporator including a heat exchange core of tube groups in plural parallel rows in a front-rear direction, each including plural heat exchange tubes in a left-right direction at a spacing, and a tank at the heat exchange core lower end and having headers in the front-rear direction. The heat exchange tubes are joined to the headers, while inserted through respective tube insertion holes in a top wall of the header. Adjacent headers connect to each other by a connector providing a drain gutter with front, rear opposite side faces extending respectively forwardly, rearwardly away from each other as the side faces extend upward. Each insertion hole has one end adjacent to the connector positioned in the drain gutter side face and each heat exchange tube has a side end adjacent to the connector positioned in the drain gutter. The connector has drain holes extending therethrough.

22 Claims, 10 Drawing Sheets

U.S. PATENT DOCUMENTS

| | | | | |
|---|---|---|---|---|
| 4,589,265 | A * | 5/1986 | Nozawa | 62/526 |
| 5,481,886 | A * | 1/1996 | Hasegawa et al. | 62/285 |
| 7,036,567 | B2 * | 5/2006 | Shimanuki et al. | 165/110 |
| 2004/0035559 | A1 * | 2/2004 | Ko et al. | 165/110 |
| 2006/0162376 | A1 | 7/2006 | Higashiyama et al. | |

FOREIGN PATENT DOCUMENTS

| | | |
|---|---|---|
| JP | 2984285 | 11/1999 |
| JP | 2002 213840 | 7/2002 |
| JP | 2003 214794 | 7/2003 |
| JP | 2004 53132 | 2/2004 |

* cited by examiner

HEAT EXCHANGER

CROSS REFERENCE TO RELATED APPLICATIONS

This application is an application filed under 35 U.S.C. §111(a) claiming the benefit pursuant to 35 U.S.C. §119(e)(1) of the filing dates of Provisional Applications No. 60/588,985 and No. 60/688,327 filed Jul. 20, 2004 and Jun. 8, 2005, respectively, pursuant to 35 U.S.C. §111(b).

TECHNICAL FIELD

The present invention relates to heat exchangers suitable for use in motor vehicle air conditioners which are refrigeration cycles of motor vehicles.

The downstream side (the direction indicated by the arrow X in FIG. 1, the right-hand side of FIG. 3) of the flow of air to be passed through air passage clearances between respective adjacent pairs of heat exchange tubes of the heat exchanger will be referred to herein and in the appended claims as "front," and the opposite side as "rear." Further the upper, lower, left and right sides of the evaporator as it is seen from behind toward the front (the upper and lower sides and the left- and right-hand sides of FIG. 2) will be referred to as "upper," "lower," "left" and "right," respectively.

BACKGROUND ART

Heretofore in wide use as motor vehicle air conditioner evaporators are those of the so-called stacked plate type which comprise a plurality of flat hollow bodies arranged in parallel and each composed of a pair of dishlike plates facing toward each other and brazed to each other along peripheral edges thereof, and a louvered corrugated fin disposed between and brazed to each adjacent pair of flat hollow bodies. In recent years, however, it has been demanded to provide evaporators further reduced in size and weight and exhibiting higher performance.

Evaporators meeting such a demand are already known which comprise a heat exchange core composed of tube groups in the form of two rows arranged in parallel in the front-rear direction and each comprising a plurality of heat exchange tubes arranged at a spacing, an upper tank disposed at the upper end of the heat exchange core and having joined thereto the upper ends of the heat exchange tubes, and a lower tank disposed at the lower end of the heat exchange core and having joined thereto the lower ends of the heat exchange tubes, the lower tank having two headers arranged in the front-rear direction and having joined thereto the respective groups of heat exchange tubes, each group of heat exchange tube having lower ends joined to each header while being inserted through tube insertion holes formed in a top wall of each header, the top wall of the header being in the form of a segment of a cylindrical surface bulging upward at the mid-portion thereof with respect to the front-rear direction, the header having front and rear side walls each having a vertical planar upper portion, the two headers being interconnected by a connector, the upper portions of the front and rear walls of the adjacent two headers and the connector thereof providing a drain gutter extending in the left-right direction and having front and rear vertical side walls, the connector having drain holes extending therethrough (see the publication of JP-A No. 2003-214794).

However, the evaporator disclosed in the publication has the problem that the upper surface of the lower tank can not be drained of condensation water efficiently since the water fails to smoothly flow from the top surfaces of the headers of the lower tank into the drain gutter.

An object of the present invention is to overcome the above problem and to provide a heat exchanger wherein the upper surface of the lower tank can be drained of water with an improved efficiency when the exchanger is used as an evaporator.

DISCLOSURE OF THE INVENTION

To fulfill the above object, the present invention comprises the following modes.

1) A heat exchanger comprising a heat exchange core composed of tube groups in the form of a plurality of rows arranged in parallel in a front-rear direction and each comprising a plurality of heat exchange tubes arranged in a left-right direction at a spacing, and a lower tank disposed at the lower end of the heat exchange core, the lower tank having a plurality of headers arranged in the front-rear direction and having joined thereto the respective groups of the heat exchange tubes, the heat exchange tubes of each tube group being joined to each of the headers while being inserted through respective tube insertion holes formed in a top wall of the header, the headers adjacent to each other being connected to each other by a connector, the adjacent headers and the connector providing a drain gutter extending in the left-right direction, the drain gutter having front and rear opposite side faces extending respectively forwardly and rearwardly outward away from each other as the side faces extend upward, each of the tube insertion holes having one end adjacent to the connector and positioned in the side face of the drain gutter, each of the heat exchange tubes having a side end adjacent to the connector and positioned in the drain gutter.

2) A heat exchanger according to par. 1) wherein the connector has a drain hole extending therethrough.

3) A heat exchanger according to par. 1) wherein the front and rear side faces of the drain gutter of the lower tank are inclined downward toward the connector with respect to a horizontal plane.

4) A heat exchanger according to par. 3) wherein the front and rear side faces of the gutter have an angle of downward inclination of at least 45 degrees.

5) A heat exchanger according to par. 1) wherein a top surface of each header of the lower tank has a horizontal flat portion continuous with the front or rear side face of the drain gutter.

6) A heat exchanger according to par. 1) wherein the headers positioned respectively at forwardly and rearwardly outer end portions of the lower tank are provided in forwardly and rearwardly outer side portions of top surfaces thereof with drain grooves extending from the respective tube insertion holes for discharging condensation water to below the lower tank therethrough.

7) A heat exchanger according to par. 6) wherein the drain grooves each have a bottom inclined gradually downward as the groove extends away from the tube insertion hole.

8) A heat exchanger according to par. 6) wherein the headers positioned respectively at the forwardly and rearwardly outer end portions of the lower tank have low portions provided respectively at the forwardly and rearwardly outer side portions of the top surfaces thereof and extending gradually downward as the low portions extend respectively forwardly and rearwardly outward.

9) A heat exchanger according to par. 8) wherein the low portions are inclined downward with respect to a horizontal plane while extending respectively forwardly and rearwardly outward.

10) A heat exchanger according to par. 9) wherein the low portions are at least 45 degrees in the angle of downward inclination with respect to the horizontal plane.

11) A heat exchanger according to par. 8) wherein the drain grooves each extend from the low portion of the header top surface to forwardly or rearwardly outer side surface of the header.

12) A heat exchanger according to par. 11) wherein a bottom of each of the drain grooves has a portion existing in the low portion of the header top surface and inclined downward with respect to a horizontal plane as the bottom portion extends forwardly or rearwardly outward.

13) A heat exchanger according to par. 12) wherein the bottom portion of the drain groove existing in the low portion of the header top surface is at least 45 degrees in the angle of downward inclination with respect to the horizontal plane.

14) A heat exchanger according to par. 11) wherein each drain groove extends from the forwardly or rearwardly outer end of each tube insertion hole to an intermediate portion of the height of the corresponding forwardly or rearwardly outer side surface of the header, and the portion of the forwardly or rearwardly outer side surface of the header where the drain groove is formed is positioned forwardly or rearwardly outwardly of a header side portion lower than the outer side surface portion, with a stepped portion formed therebetween, the drain groove having a lower end opened at the stepped portion.

15) A heat exchanger according to par. 1) wherein the lower tank comprises a first member having the heat exchange tubes joined thereto, and a second member joined to the first member at a portion thereof opposite to the heat exchange tubes, each of the first member and the second member comprising a plurality of header portions arranged in the front-rear direction and a connecting wall interconnecting the header portions adjacent to each other, the two members being joined to each other at front and rear side edges thereof and at the connecting walls thereof, the header portions of the two members providing the headers, the connecting walls providing the connector.

16) A heat exchanger according to par. 15) wherein a stepped portion is provided at each of joints between the first member and the second member at the front and rear side edges thereof, whereby front and rear side surfaces of the header portions at forwardly and rearwardly outer ends of the first member are positioned respectively forwardly and rearwardly outwardly of respective front and rear side surfaces of the header portions at forwardly and rearwardly outer ends of the second member, with the respective stepped portions provided therebetween.

17) A heat exchanger according to par. 1) wherein left and right opposite side portions of each tube insertion hole in a top surface of the lower tank are inclined downward toward the tube insertion hole.

18) A heat exchanger according to par. 1) wherein the heat exchange tubes are flat and have their width positioned in the front-rear direction and are 0.75 to 1.5 mm in tube height which is the thickness thereof.

19) A heat exchanger according to par. 1) wherein fins are arranged between respective adjacent pairs of heat exchange tubes and are each a corrugated fin comprising crest portions, furrow portions and flat connecting portions interconnecting the crest portions and the furrow portions, the fins being 7.0 mm to 10.0 mm in height which is the straight distance from the crest portion to the furrow portion, and 1.3 to 1.7 mm in fin pitch which is the pitch of connecting portions.

20) A heat exchanger according to par. 19) wherein the crest portion and the furrow portion of the fin each comprise a flat portion, and a rounded portion provided at each of opposite sides of the flat portion and integral with the connecting portion, the rounded portion being up to 0.7 mm in radius of curvature.

21) A heat exchanger according to par. 1) which comprises a refrigerant inlet header disposed toward the upper ends of the heat exchange tubes and on a front side and having joined thereto at least one row of heat exchange tubes, a refrigerant outlet header disposed toward the upper ends of the heat exchange tubes and in the rear of the inlet header and having joined thereto at least one row of heat exchange tubes, and a lower tank having two headers.

22) A refrigeration cycle comprising a compressor, condenser and an evaporator, the evaporator comprising a heat exchanger according to any one of pars. 1) to 21).

23) A vehicle having installed therein a refrigeration cycle according to par. 22) as a motor vehicle air conditioner.

With the heat exchanger according to par. 1), the headers of the lower tank adjacent to each other and the connector provide a drain gutter, which has front and rear side faces extending respectively forwardly and rearwardly outward away from each other as the side faces extend upward. The end of each tube insertion hole adjacent to the connector is positioned in the side face of the drain gutter, and the side end of each heat exchange tube adjacent to the connector is positioned in the drain gutter. The lower tank can therefore be drained of condensation water from the upper surfaces of the headers with an improved efficiency. The condensation water is thus prevented from collecting on the lower tank in a large amount to obviate the likelihood that the condensation water will freeze, consequently precluding the impairment of performance of the heat exchanger when it is used as an evaporator. Stated more specifically, the condensation water produced on the surfaces of the fins arranged between respective adjacent pairs of heat exchange tubes or on the surfaces of the tubes generally flows down the end faces of the tubes. When the end of each tube insertion hole adjacent to the connector is positioned in the side face of the drain gutter, and the side end of each heat exchange tube adjacent to the connector is positioned in the drain gutter, the condensation water flowing down the end faces of heat exchange tubes will flow directly into the drain gutter, reducing the amount of condensation water remaining on the header surfaces of the lower tank to drain the lower tank headers of water with an improved efficiency.

With the heat exchanger according to par. 2), the condensation water flowing into the drain gutter flows through the drain hole and falls to below the lower tank. This eliminates the likelihood that the condensation water inside the gutter will remain therein.

With the heat exchanger according to par. 3), the condensation water flowing down the end faces of heat exchange tubes promptly flows into the gutter by being greatly influenced by gravity.

The heat exchanger according to par. 4) exhibits the advantage of the par. 3) remarkably.

With the heat exchanger according to par. 5), the condensation water on the horizontal flat portions of the top surfaces of the lower tank headers is entrained by the air flowing through the air passage clearances between the respective adjacent pairs of heat exchange tubes to flow downstream with respect to the direction of flow of the air, i.e., toward the front, overcoming surface tension acting to retain the water on the horizontal flat surfaces. Accordingly, a large quantity of condensation water is prevented from collecting on the lower tank headers and therefore from freezing although the water would freeze if collecting in a large amount, whereby inefficient performance of the heat exchanger is precluded when it is used as an evaporator.

With the heat exchanger according to par. 6), the condensation water flowing down the forwardly or rearwardly outer end faces of the heat exchange tubes joined to the headers at the forwardly and rearwardly outer end portions flows through the drain grooves and is discharged to below the lower tank. Accordingly, the headers at the forwardly and rearwardly outer end portions of the lower tank can be drained of condensation water with an improved efficiency. A large quantity of condensation water is therefore prevented from collecting on the headers and also from freezing although the water would freeze if collecting in a large amount, whereby inefficient performance of the heat exchanger is precluded when it is used as an evaporator.

The heat exchanger according to par. 7) permits condensation water to smoothly flow through the drain grooves to achieve an improved drainage efficiency.

With the heat exchanger according to par. 8) or 9), gravity exerts great influence on the condensation water flowing down the forwardly or rearwardly outer end faces of the heat exchange tubes joined to the headers at the forwardly and rearwardly outer end portions, with the result that the water is less likely to remain on the header portions owing to surface tension to achieve an improved drainage efficiency.

The heat exchanger according to par. 10) exhibits the advantage of par. 8) or 9) remarkably.

With the heat exchanger according to par. 11), the condensation water flowing through the drain grooves falls to below the lower tank from the lower ends of groove portions existing in the forwardly and rearwardly outer side surfaces of the headers, whereby an improved drainage efficiency is achieved.

With the heat exchanger according to par. 12), a relatively great gravitational force acts on the condensation water inside the drain grooves, causing the water to overcome the surface tension acting to retain the water in the drain grooves for the discharge of the water.

The heat exchanger according to par. 13) exhibits the advantage of par. 12) remarkably.

With the heat exchanger according to par. 14), the condensation water smoothly falls to below the lower tank from the lower-end openings of the drain groove portions existing in the forwardly and rearwardly outer surfaces of the headers.

With the heat exchanger according to par. 15), the first member having the header portions, platelike portions and tube insertion holes can be made, for example, from a metal blank sheet by press work, and is relatively easy to make. The second member having header portions and platelike portions can be made, for example, by extrusion and is relatively easy to make.

With the heat exchanger according to par. 16), the front and rear side edge portions of the first member can be positioned respectively forwardly and rearwardly outwardly of the respective front and rear side edges of the second member relatively easily.

With the heat exchanger according to par. 17), recesses positioned at lower end portions of the heat exchange tubes are defined by the left and right slanting side portions of the tube insertion holes in the top surfaces of the lower tank headers. The condensation water flowing into the recesses flows down opposite side faces of the drain gutter to enter the gutter. This reduces the amount of condensation water remaining on the lower tank headers to drain the headers of water with an improved efficiency.

With the heat exchanger according to par. 18) or 19), an improved heat exchange efficiency can be achieved while an increase in air passage resistance can be suppressed, with a good balance maintained between these two features.

BEST MODE OF CARRYING OUT THE INVENTION

An embodiments of the present invention will be described below with reference to the drawings. The embodiment is a heat exchanger of the invention for use as an evaporator in motor vehicle air conditioners wherein a chlorofluorocarbon refrigerant is used.

Figure 1:
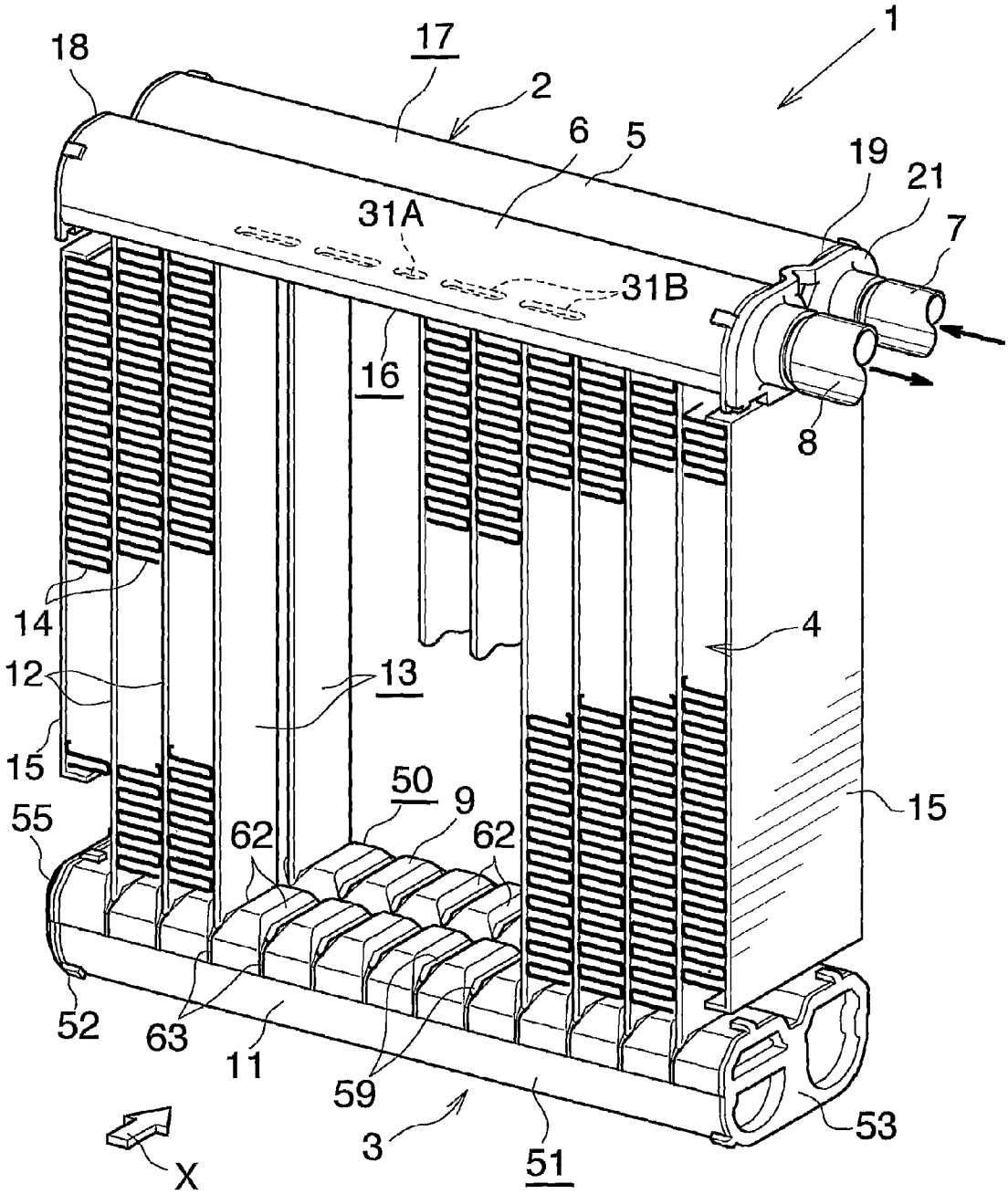
FIG. 1 is a perspective view partly broken away and showing the overall construction of an evaporator to which a heat exchanger of the invention is applied.
Figure 2:
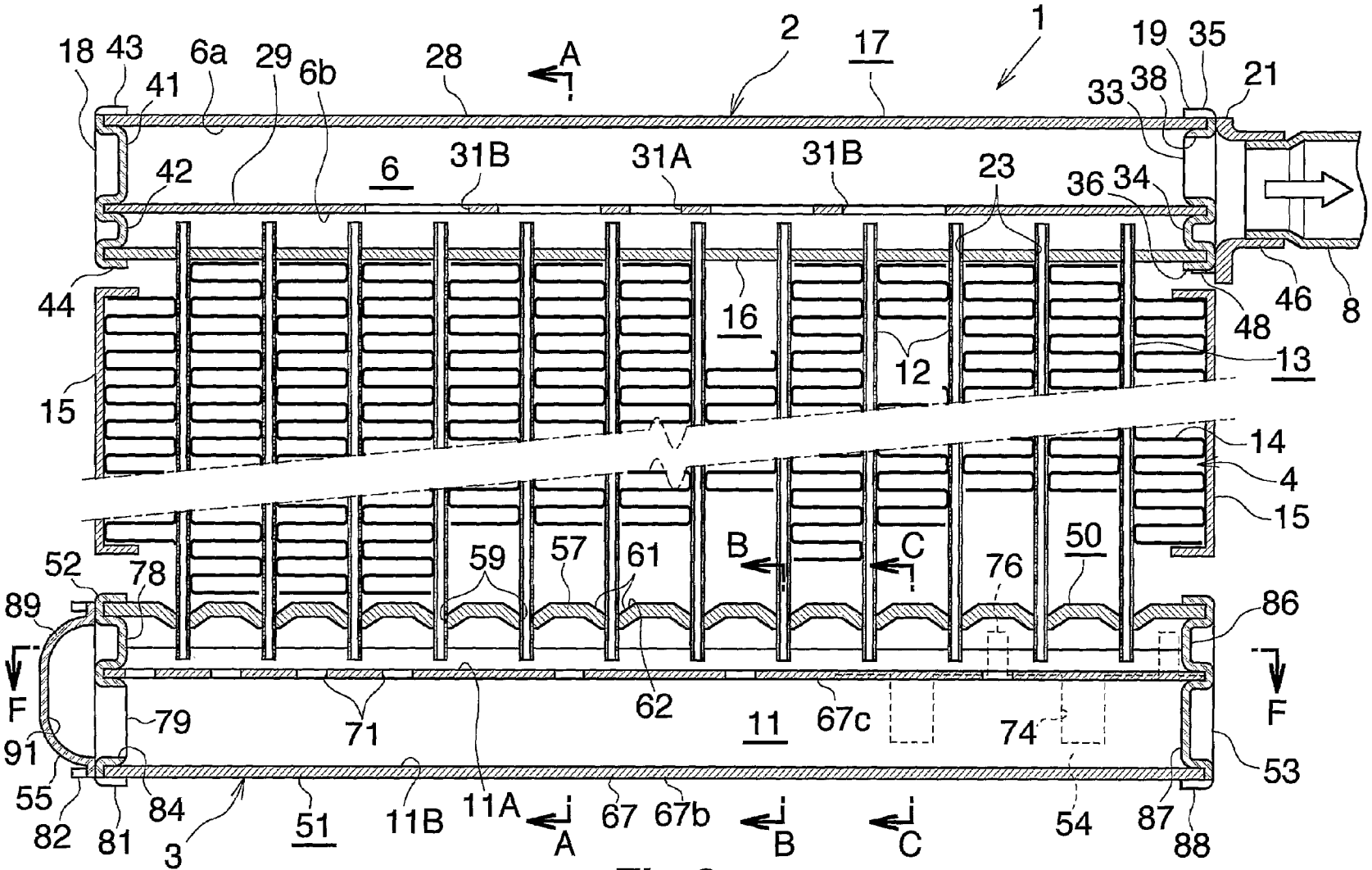
FIG. 2 is a view in vertical section and showing the evaporator of FIG. 1 as it is seen from behind, with an intermediate portion omitted.
Figure 3:
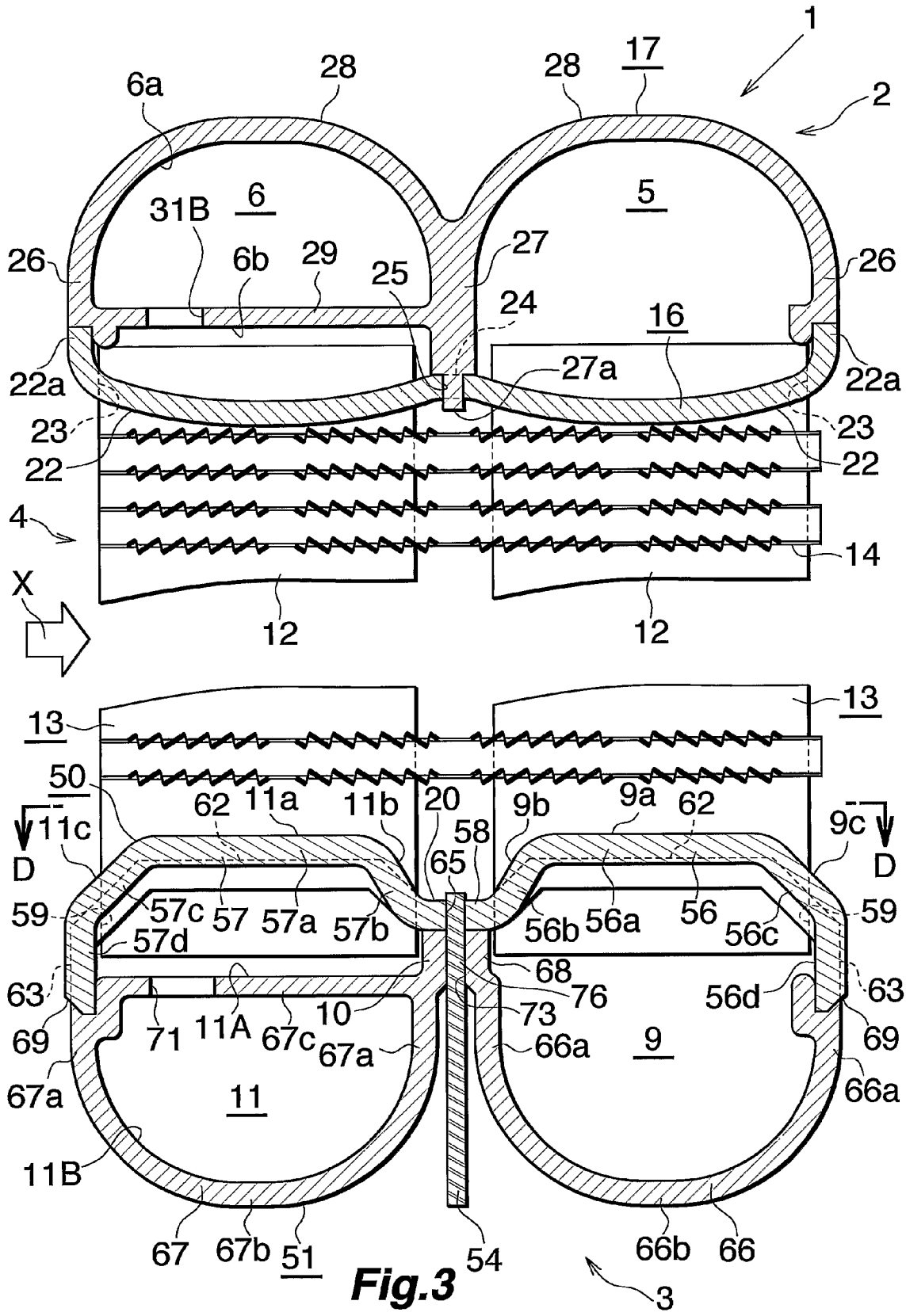
FIG. 3 is an enlarged fragmentary view in section taken along the line A-A in FIG. 2.
Figure 11:
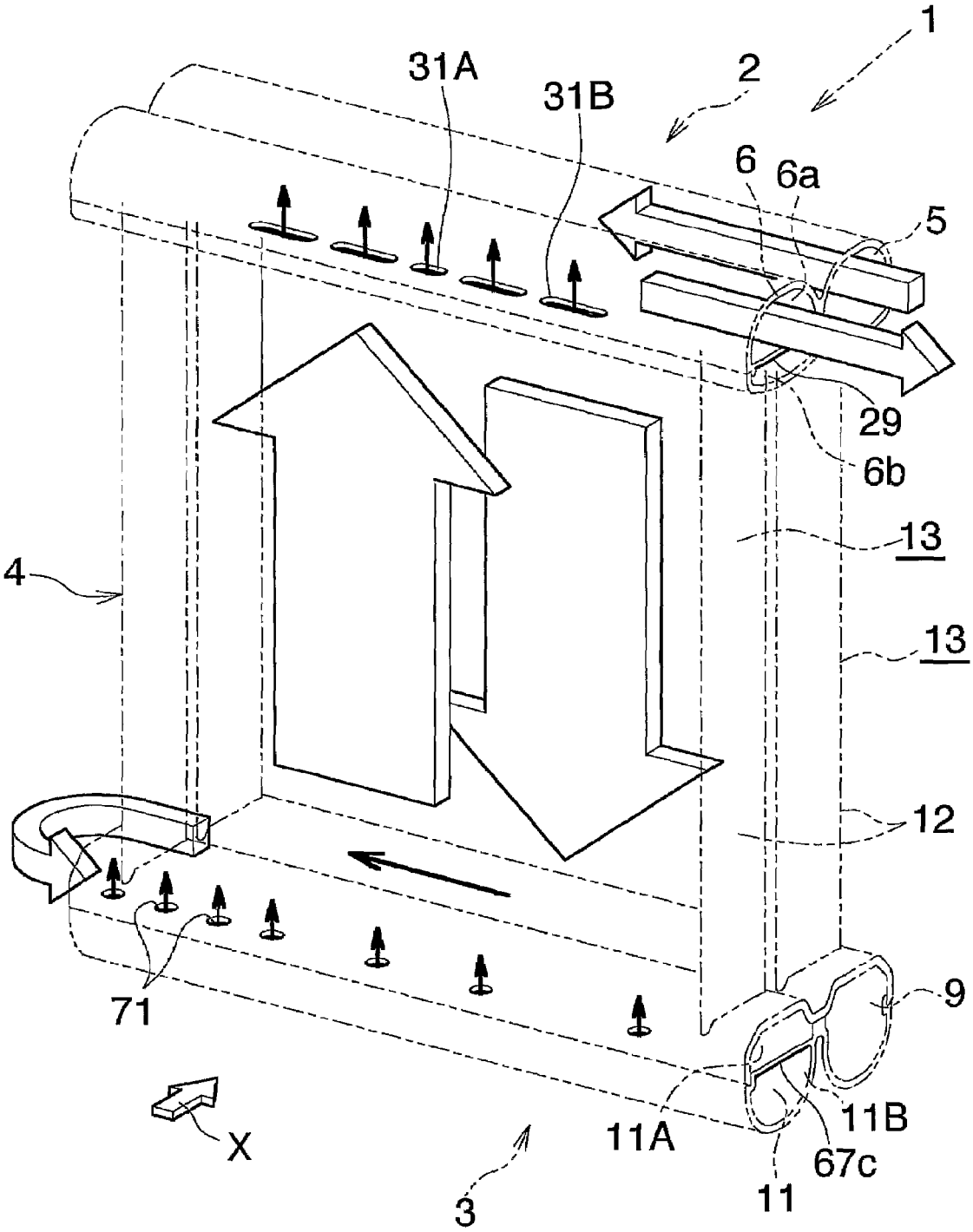
FIG. 11 is a diagram showing how a refrigerant flows through the evaporator shown in FIG. 1.

FIGS. 1 to 3 show the overall construction of a motor vehicle air conditioner evaporator to which the heat exchanger of the invention is applied, FIGS. 4 to 10 show the constructions of main parts, and FIG. 11 shows how the refrigerant flows through the evaporator.

FIGS. 1 to 3 show an evaporator 1 for use in motor vehicle air conditioners wherein a chlorofluorocarbon refrigerant is used. The evaporator 1 comprises a refrigerant inlet-outlet tank 2 of aluminum and a refrigerant turn tank 3 of aluminum (lower tank) which are arranged one above the other as spaced apart, and a heat exchange core 4 provided between the two tanks 2, 3.

The refrigerant inlet-outlet tank 2 comprises a refrigerant inlet header 5 positioned on the front side (the downstream side with respect to the direction of flow of air through the evaporator), and a refrigerant outlet header 6 positioned on the rear side (the upstream side with respect to the flow of air). A refrigerant inlet pipe 7 of aluminum is connected to the inlet header 5 of the tank 2, and a refrigerant outlet pipe 8 of aluminum to the outlet header 6 of the tank. The refrigerant turn tank 3 comprises a refrigerant inflow header 9 positioned on the front side, and a refrigerant outflow header 11 positioned on the rear side. The two headers 9, 11 are connected to each other by a connector 10, and the two headers 9, 11 and the connector 10 provide a drain gutter 20.

The heat exchange core 4 comprises tube groups 13 in the form of a plurality of rows, i.e., two rows in the present embodiment, as arranged in the front-rear direction, each tube group 13 comprising a plurality of heat exchange tubes 12 arranged in parallel in the left-right direction at a spacing. Corrugated fins 14 are arranged respectively in air passing clearances between respective adjacent pairs of heat exchange tubes 12 of each tube group 13 and also outside the heat exchange tubes 12 at the left and right opposite ends of each tube group 13, and are each brazed to the heat exchange tube 12 adjacent thereto. An aluminum side plate 15 is disposed outside the corrugated fin 14 at each of the left and right ends and brazed to the fin 14. The heat exchange tubes 12 of the front tube group 13 have upper and lower ends joined respectively to the inlet header 5 and the inflow header 9, and the heat exchange tubes 12 of the rear tube group 13 have upper and lower ends joined respectively to the outlet header 6 and the outflow header 11. The inflow header 9, the outflow header 11 and all heat exchange tubes 12 constitute a refrigerant circulating passage for causing the inlet header 5 to communicate with the outlet header 6 therethrough.

Figure 4:
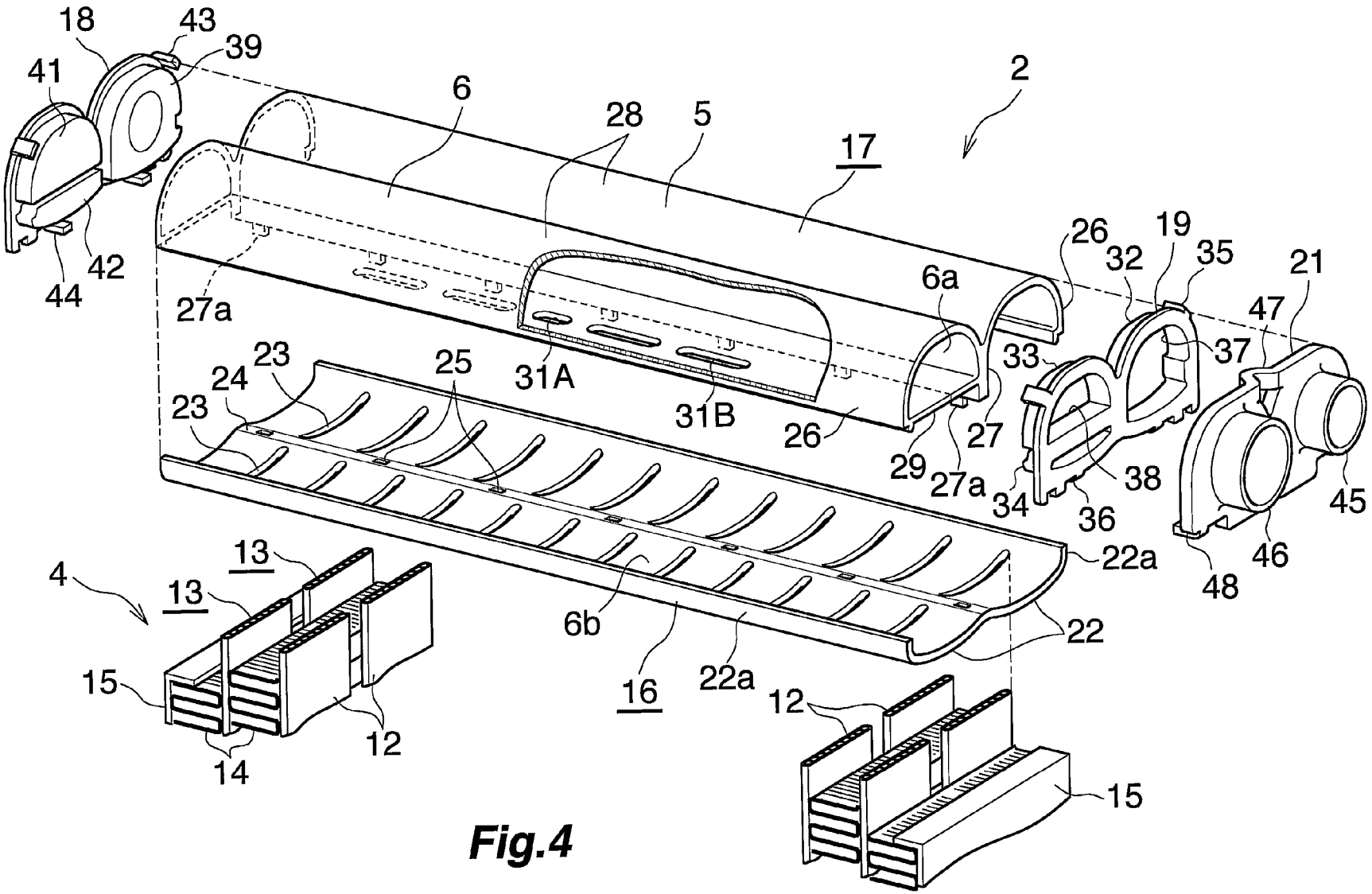
FIG. 4 is an exploded perspective view of a refrigerant inlet-outlet tank of the evaporator of FIG. 1.
Figure 5:
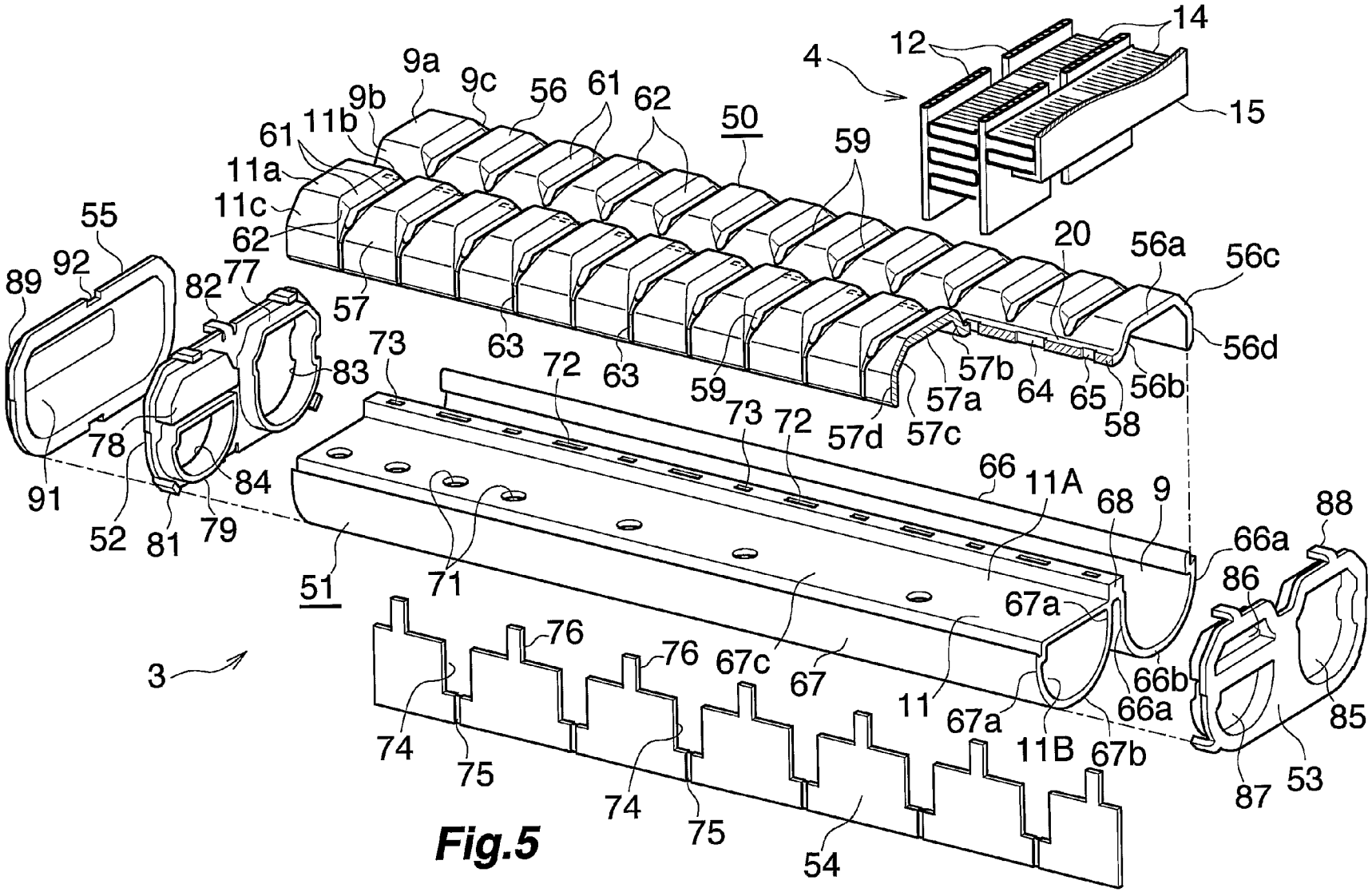
FIG. 5 is an exploded perspective view of a refrigerant turn tank of the evaporator of FIG. 1.
Figure 6:
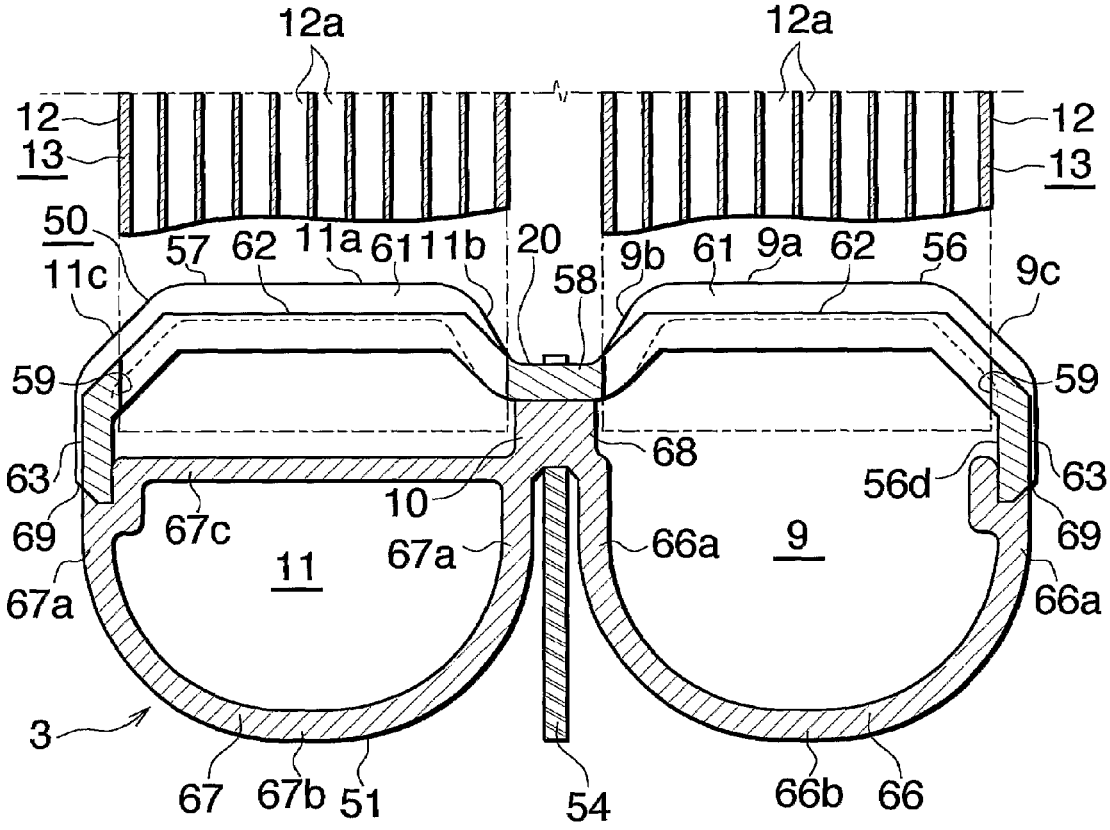
FIG. 6 is an enlarged fragmentary view in section taken along the line B-B in FIG. 2.
Figure 7:
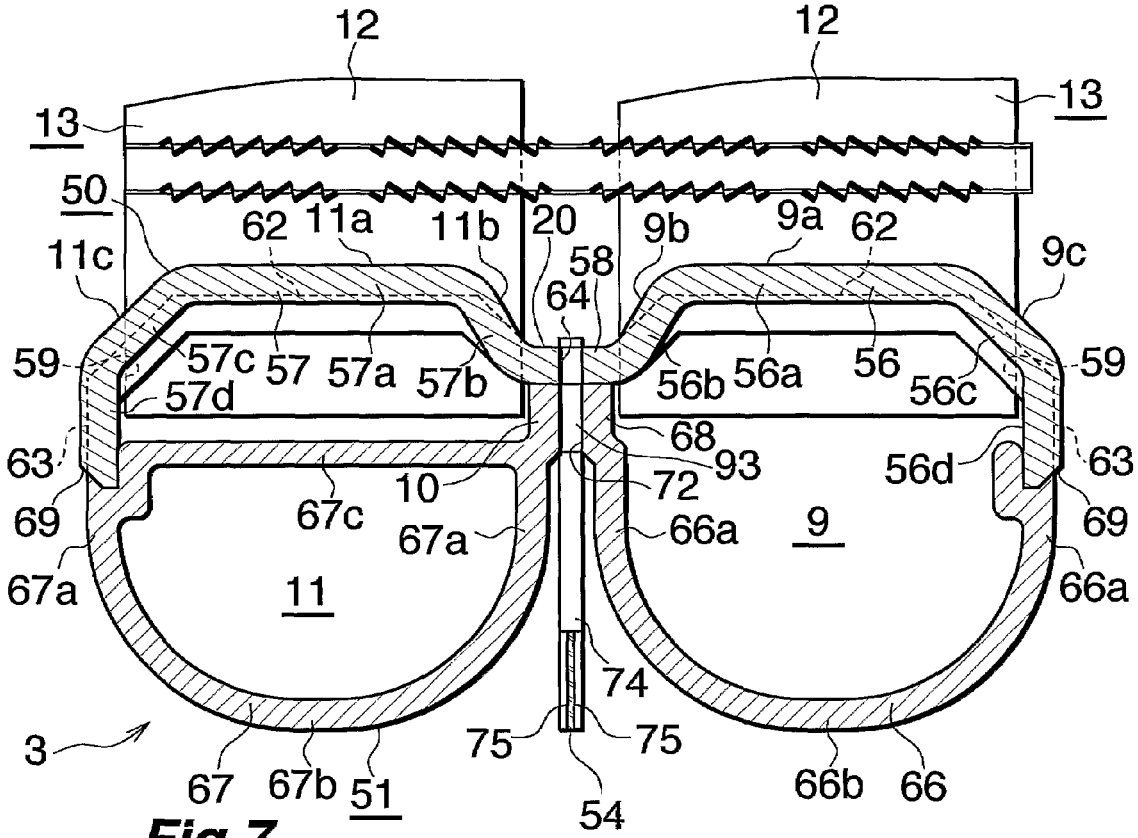
FIG. 7 is an enlarged view in section taken along the line C-C in FIG. 3.
Figure 8:
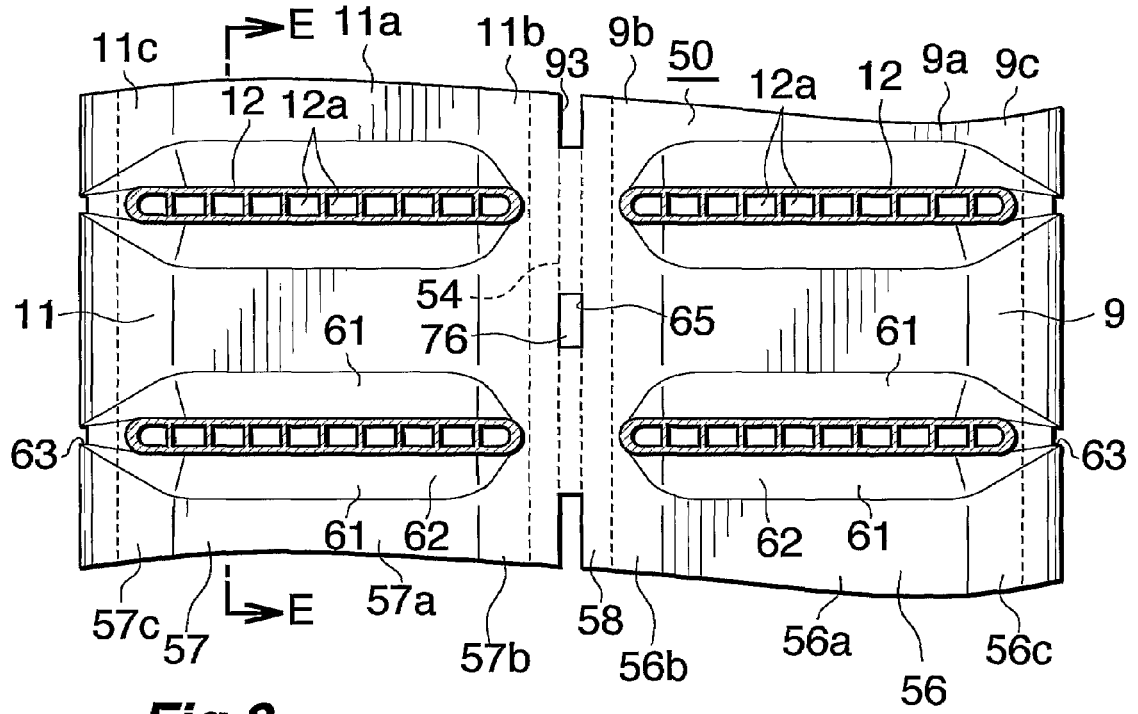
FIG. 8 is a view in section taken along the line D-D in FIG. 3.
Figure 9:
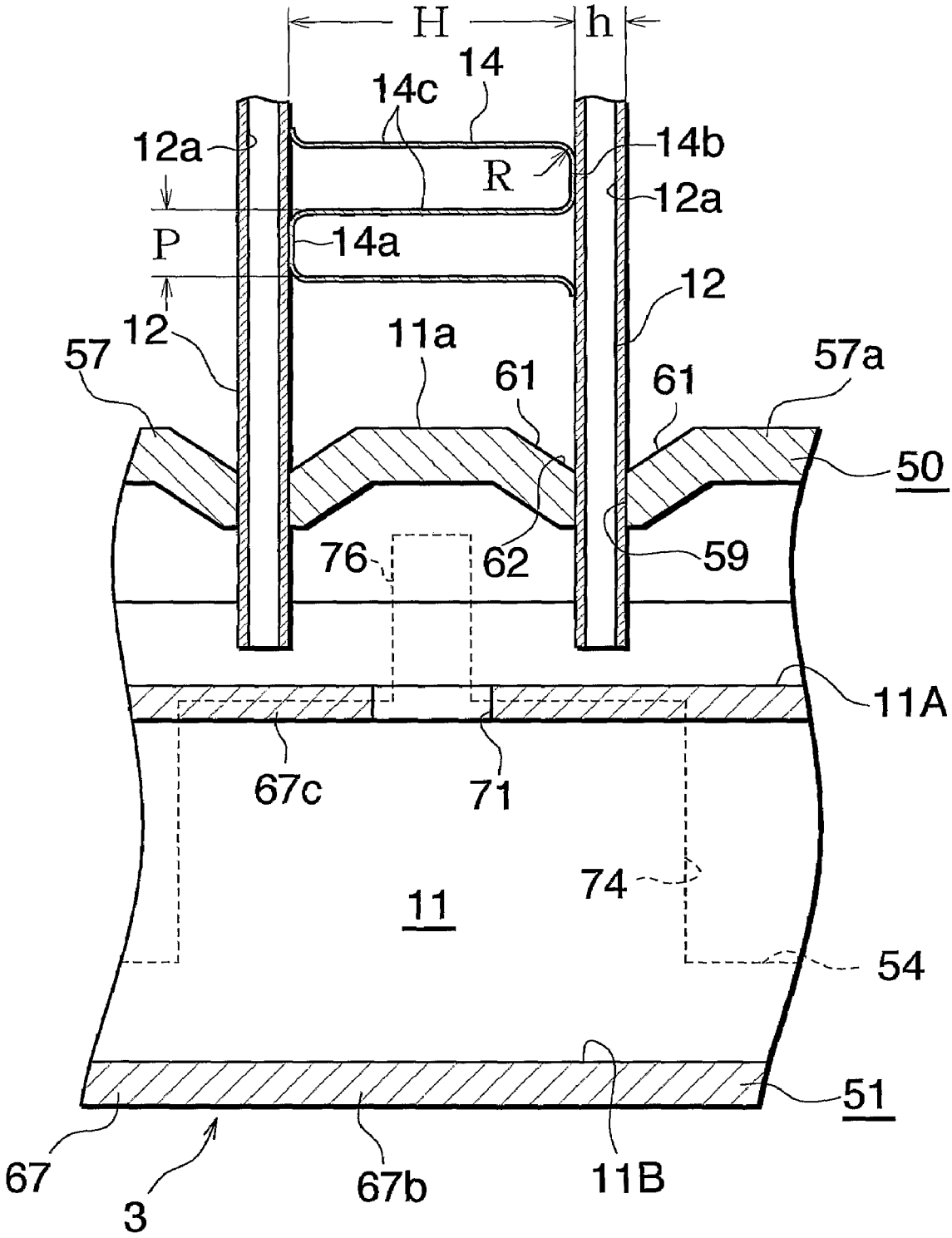
FIG. 9 is a view in section taken along the line E-E in FIG. 8.
Figure 10:
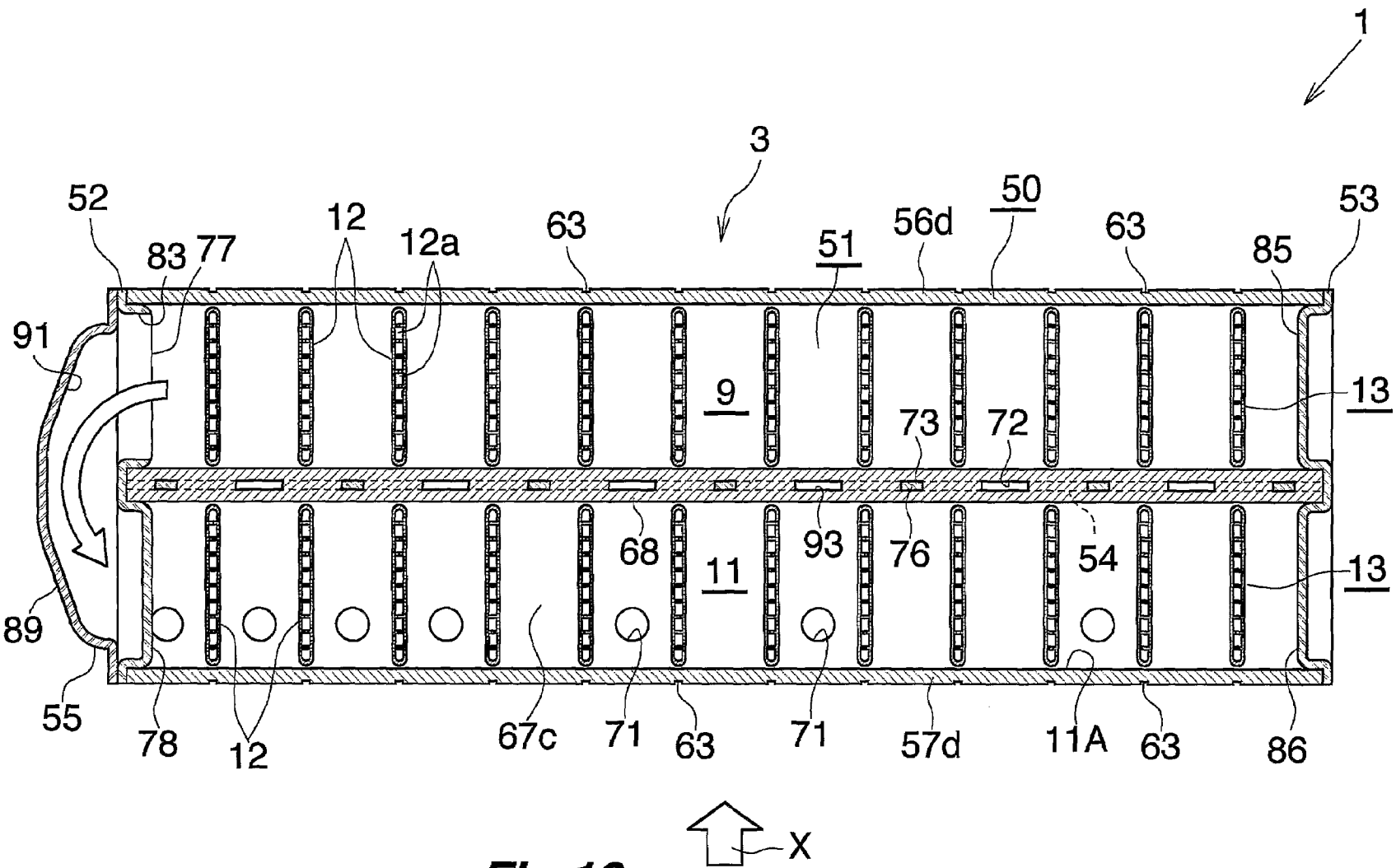
FIG. 10 is a vies in section taken along the line F-F in FIG. 2.

With reference to FIGS. 2 to 4, the refrigerant inlet-outlet tank 2 comprises a platelike first member 16 made of an aluminum brazing sheet having a brazing material layer over opposite surfaces thereof and having the heat exchange tubes 12 joined thereto, a second member 17 of bare aluminum extrudate and covering the upper side of the first member 16, and aluminum caps 18, 19 made of an aluminum brazing sheet having a brazing material layer over opposite surfaces thereof and joined to opposite ends of the two members 16, 17 for closing the respective opposite end openings. An aluminum joint plate 21 elongated in the front-rear direction is brazed to the outer surface of the cap 19 at the right end so as to cover both the inlet header 5 and the outlet header 6. The refrigerant inlet and outlet pipes 7, 8 are joined to the joint plate 21.

The first member 16 has at each of the front and rear side portions thereof a curved portion 22 in the form of a circular arc of small curvature in cross section and bulging downward at its midportion. The curved portion 22 has a plurality of tube insertion holes 23, i.e., slits 23, elongated in the front-rear direction and arranged at a spacing in the left-right, i.e., lateral, direction. Each corresponding pair of slits 23 in the front and rear curved portions 22 are in the same position with respect to the lateral direction. The front edge of the front curved portion 22 and the rear edge of the rear curved portion 22 are integrally provided with respective upstanding walls 22*a* extending over the entire length of the member 16. The first member 16 includes between the two curved portions 22 a flat portion 24 having a plurality of through holes 25 arranged at a spacing in the lateral direction.

The second member 17 is generally m-shaped in cross section and opened downward and comprises front and rear two walls 26 extending laterally, a partition wall 27 provided in the midportion between the two walls 26 and extending laterally as separating means for dividing the interior of the refrigerant inlet-outlet tank 2 into front and rear two spaces, and two generally circular-arc connecting walls 28 bulging upward and integrally connecting the partition wall 27 to the respective front and rear walls 26 at their upper ends. The rear wall 26 and the partition wall 27 are integrally interconnected at their lower ends over the entire length of the member 17 by a flow dividing resistance plate 29. The resistance plate 29 has refrigerant passing through holes 31A, 31B elongated laterally, formed therein at a rear portion thereof other than the left and right end portions of the plate and arranged at a spacing laterally thereof. The partition wall 27 has a lower end projecting downward beyond the lower ends of the front and rear walls 26 and is integrally provided with a plurality of projections 27*a* projecting downward from the lower edge of the wall 27, arranged at a spacing in the lateral direction and fitted into the through holes 25 of the first member 16. The projections 27*a* are formed by cutting away specified portions of the partition wall 27.

The right cap 19 is integrally provided, at its front portion, with a leftward protrusion 32 to be fitted into the inlet header 5. The cap 19 is integrally provided, at its rear portion, with an upper leftward protrusion 33 to be fitted into an upper portion of the outlet header 6 above the resistance plate 29 and with a lower leftward protrusion 34 positioned below and spaced apart from the protrusion 33 and to be fitted into a lower portion of the header 6 under the plate 29. The right cap 19 has an engaging lug 35 projecting leftward and formed integrally therewith on a circular-arc portion between its upper edge and each of the front and rear side edges thereof. The right cap 19 further has an engaging lug 36 projecting leftward and formed integrally therewith on each of front and rear portions of its lower edge. A refrigerant inlet 37 is formed in the bottom wall of the leftward protrusion 32 of the front portion of the right cap 19. A refrigerant outlet 38 is formed in the bottom wall of the upper leftward protrusion 33 of the rear portion of the right cap 19. The left cap 18 is symmetric to the right cap 19. The left cap 18 has formed integrally therewith a rightward protrusion 39 fittable into the inlet header 5, an upper rightward protrusion 41 fittable into the upper portion of the outlet header 6 above the resistance plate 29, a lower rightward protrusion 42 fittable into the lower portion of the header 6 below the resistance plate 29, and upper and lower engaging lugs 43, 44 projecting rightward. No opening is formed in the bottom walls of the rightward protrusion 39 and the upper rightward protrusion 41. The two caps 18, 19 each have an upper edge comprising two generally circular-arc front and rear portions joined to each other in alignment by a midportion so as to conform in shape to the shape of the inlet-outlet tank second member 17. The two caps 18, 19 each have a lower edge comprising two generally circular-arc front and rear portions joined to each other in alignment by a middle flat portion so as to substantially conform in shape to the shape of the inlet-outlet tank first member 16.

The joint plate 21 has a short cylindrical refrigerant inlet portion 45 communicating with the inlet 37 of the right cap 19, and a short cylindrical refrigerant outlet portion 46 communicating with the outlet 38 of the cap. Between the inlet portion 45 and the outlet portion 46, the joint plate 21 is provided with an upper and a lower bent portion 47 projecting leftward respectively from the upper and lower edges thereof. The upper bent portion 47 is engaged with the upper edge portion of the right cap 19 between the two circular-arc portions and with the portion of the second member 17 between the two connecting walls 28. The lower bent portion 47 is in engagement with the middle flat portion of lower edge of the right cap 19 between the two circular-arc portions of the lower edge and with the flat portion 24 of the first member 16. The joint plate 21 further has an engaging lug 48 formed integrally therewith and projecting leftward from each of the front and rear ends of its lower edge. The lug 48 is in engagement with the lower edge of the right cap 19. A constricted end portion of the refrigerant inlet pipe 7 is inserted into and brazed to the refrigerant inlet portion 45 of the joint plate 21, and a constricted end portion of the refrigerant outlet pipe 8 is inserted into and brazed to the outlet portion 46 of the same plate. Although not shown, an expansion valve mount member is joined to and positioned across the other end portions of the inlet pipe 7 and the outlet pipe 8.

The first and second members 16, 17 of the refrigerant inlet-outlet tank 2, the two caps 18, 19 and the joint plate 21 are brazed together in the following manner. The first and second members 16, 17 are brazed to each other utilizing the brazing material layer of the first member 16, with the projections 27*a* of the second member 17 inserted through the respective through holes 25 of the first member 16 in crimping engagement therewith and with the upper ends of the front and rear upstanding walls 22*a* of the first member 16 thereby engaged with the lower ends of the front and rear walls 26 of the second member 17. The two caps 18, 19 are brazed to the first and second members 16, 17 utilizing the brazing material layers of the caps 18, 19, with the protrusions 39, 32 of the front portions fitting in the front space inside the two members 16, 17 forwardly of the partition wall 27, with the upper protrusions 41, 33 of the rear portions fitting in the upper space inside the two members 16, 17 rearwardly of the partition wall 27 and above the resistance plate 29, with the lower protrusions 42, 34 of the rear portions fitting in the lower space rearwardly of the partition wall 27 and below the resistance plate 29, with the upper engaging lugs 43, 35 engaged with the connecting walls 28 of the second member 17, and with the lower engaging lugs 44, 36 engaged with the curved portions 22 of the first member 16. The joint plate 21 is brazed to the right cap 19 utilizing the brazing material layer of the cap 19, with the bent portions 47 in engagement with the right cap 19 and the second member 17, and with the engaging lugs 48 engaged with the right cap 19.

In this way, the refrigerant inlet-outlet tank 2 is made. The portion of the second member 17 forwardly of the partition wall 27 serves as the inlet header 2, and the portion of the member 17 rearward of the partition wall 27 as the outlet header 6. The outlet header 6 is divided by the flow dividing resistance plate 29 into upper and lower spaces 6*a*, 6*b*, which are held in communication by the refrigerant passing holes 31A, 31B. The refrigerant outlet 38 of the right cap 19 is in communication with the upper space 6*a* of the outlet header 6. The refrigerant inlet portion 45 of the joint plate 21 communicates with the refrigerant inlet 37, and the refrigerant outlet portion 46 thereof communicates with the outlet 38.

With reference to FIGS. 2, 3 and 5 to 10, the refrigerant turn tank 3 comprises a platelike first member 50 made of aluminum brazing sheet having a brazing material layer over opposite surfaces thereof and having the heat exchange tubes 12 joined thereto, a second member 51 made of bare aluminum extrudate and covering the lower side of the first member 50, aluminum caps 52, 53 made of aluminum brazing sheet having a brazing material layer over opposite surfaces thereof for closing left and right opposite end openings, a drain assisting plate 54 made of bare aluminum material, elongated in the left-right direction and joined to the connector 10, and a communication member 55 made of bare aluminum material, elongated in the front-rear direction and brazed to the outer side of the left cap 52 so as to extend across both the inflow header 9 and the outflow header 11. The inflow header 9 is caused to communicate with the outflow header 11 at their left ends through the communication member 55.

Each of the inflow header 9 and the outflow header 11 has a top surface, front or rear outer side surface and a bottom surface. The top surfaces of the inflow and outflow headers 9, 11 are horizontal flat surfaces 9*a*, 11*a* except at their inner and outer portions with respect to the front-rear direction. The inner portions of the top surfaces with respect to the front-rear direction are in the form of slanting surfaces, i.e., first low portions 9*b*, 11*b*, slanting downward straight as they extend forwardly or rearwardly inward. The first low portions 9*b*, 11*b* serve respectively as the front and rear side faces of the gutter 20. The front and rear opposite side faces of the gutter 20 extend respectively forwardly and rearwardly away from each other as they extend upward. The angle of downward inclination of the first low portions 9*b*, 11*b* with respect to a horizontal plane is preferably at least 45 degrees. The front and rear side faces of the gutter 20, i.e., the first low portions 9*b*, 11*b* of the headers 9, 11, need not always be slanted straight but may be curved insofar as they extend respectively forwardly and rearwardly away from each other as they extend upward. Formed respectively at the outer side portions, with respect to the front-rear direction, of the top surfaces of the two headers 9, 11 are the second low portions 9*c*, 11*c*, which are in the form of slanting surfaces inclined downward straight as they extend respectively forwardly and rearwardly outward. The angle of downward inclination of the second low portions 9*c*, 11*c* with respect to a horizontal plane is preferably at least 45 degrees. The front and rear outer side surfaces of the respective headers 9, 11 are continuous with the respective second low portions 9*c*, 11*c* of their top surfaces.

The first member 50 comprises a first header portion 56 making the upper portion of the inflow header 9, a second header portion 57 making the upper portion of the outflow header 11, and a connecting wall 58 interconnecting the two header portions 56, 57 and providing the connector 10. The first header portion 56 comprises a horizontal flat top wall 56*a*, a first slanting wall 56*b* integral with the rear edge of the top wall 56*a* over the entire length thereof and downwardly inclined toward the rear, a second slanting wall 56*c* integral with the front edge of the top wall 56*a* over the entire length thereof and downwardly inclined toward the front, and a depending wall 56*d* integral with the front edge of the second slanting wall 56*c* over the entire length thereof. The second header portion 57 comprises a horizontal flat top wall 57*a*, a first slanting wall 57*b* integral with the front edge of the top wall 57*a* over the entire length thereof and downwardly inclined toward the front, a second slanting wall 57*c* integral with the rear edge of the top wall 57*a* over the entire length thereof and downwardly inclined toward the rear, and a depending wall 57*d* integral with the rear edge of the second slanting wall 57*c* over the entire length thereof. The lower edge of first slanting wall 56*b* of the first header portion 56 is connected to the lower edge of the first slanting wall 57*a* of the second header portion 57 by the connecting wall 58. The depending walls 56*d*, 57*d* of the header portions 56, 57 have respective lower end faces which are inclined downwardly inward with respect to the front-rear direction. The outer portion of each of the lower end faces provides a stepped portion 69 as will be described later. The upper surface of the top wall 56*a* of the first header portion 56 provides the horizontal flat top surface 9*a* of the inflow header 9, the upper surfaces of the slanting walls 56*b*, 56*c* provide two low portions 9*b*, 9*c*, and the outer surface of the depending wall 56*d* provides an upper portion of the front side surface. The upper surface of the top wall 57*a* of the second header portion 57 provides the horizontal flat top surface 11*a* of the outflow header 11, the upper surfaces of the slanting walls 57*b*, 57*c* provide two low portions 11*b*, 11*c*, and the outer surface of the depending wall 57*d* provides an upper portion of the rear side surface.

The header portions 56, 57 of the first member 50 each have a plurality of tube insertion holes, i.e., tube insertion slits 59, which are elongated in the front-rear direction and arranged in the left-right direction, i.e., in the lateral direction, at a spacing. Each tube insertion slit 59 in the header portion 56 and the tube insertion slit 59 of the header portion 57 corresponding thereto are in the same position with respect to the lateral direction. The ends of tube insertion slits 59 adjacent to the connector 10, i.e., the rear end of the tube insertion slit 59 in the first header portion 56, and the front end of the tube insertion slit 59 in the second header portion 57 are positioned respectively in the first slanting walls 56*b*, 57*b*. Thus, the ends of these tube insertion slits 59 adjacent to the connector 10 are positioned in the respective side faces of the drain gutter 20. Furthermore, the forwardly or rearwardly outer ends of these tube insertion slits 59, i.e., the front end of the slit 59 in the first header portion 56 and the rear end of the slit 59 in the second header portion 57, are positioned respectively in the second slanting walls 56*c*, 57*c*. Thus, the forwardly or rearwardly outer ends of these slits 59 are positioned respectively in the second low portions 9*c*, 11*c* of top surfaces of the headers 9, 11.

Left and right opposite side portions of each of the tube insertion slits 59 in the slanting walls 56*b*, 56*c*, 57*b*, 57*c* of top walls 56*a*, 57*a* of the header portions 56, 57 of the first member 50 are in the form of slanting portions 61 inclined downward toward the slit 59. The slanting portions 61 on the left and right opposite sides of each slit 59 define a recess 62 (see FIG. 9). Drain grooves 63 for discharging condensation water to below the turn tank 3 are formed in the outer surfaces of the second slanting walls 56*c*, 57*c* of the header portions 56, 57 of the first member 50 and the outer surfaces of the depending walls 56*d*, 57*d* thereof and extend from the forwardly or rearwardly outer ends of the respective tube insertion slits 59. Each of the drain grooves 63 has a bottom extending gradually downward as the bottom extends away from the tube insertion slit 59. The bottom of the drain groove 63 has a portion existing in the second slanting wall 56*c* or 57*c*, i.e., in the second low portion 9*c* or 11*c* and inclined downward straight with respect to a horizontal plane as the bottom portion extends forwardly or rearwardly outward. The bottom portion of the drain groove 63 existing in the second low portion 9*c* or 11*c* is preferably at least 45 degrees in the angle of downward inclination with respect to the horizontal plane. The portion of the drain groove 63 existing in the depending wall 56*d* or 57*d* has a lower-end opening in the lower end face of the wall 56*d* or 57*d* (see FIG. 6).

The connecting wall 58 of the first member 50 has a plurality of drain through holes 64 elongated in the lateral direction and arranged laterally at a spacing. The connecting wall 58 has a plurality of fixing through holes 65 arranged at a spacing and positioned as displaced from the holes 64.

The first member 50 is made from an aluminum brazing sheet by press work to form the top walls 56*a*, 57*a*, slanting walls 56*b*, 56*c*, 57*b*, 57*c*, depending walls 56*d*, 57*d*, connecting wall 58, tube insertion slits 59, slanting portions 61 and drain grooves 63 of the two header portions 56, 57, and the drain through holes 64 and fixing through holes 65 in the connecting wall 58.

The second member 51 comprises a first header portion 66 making the lower portion of the inflow header 9, a second header portion 67 making the lower portion of the outflow header 11, and a connecting wall 68 interconnecting the header portions 66, 67 and brazed to the connecting wall 58 of the first member 50 to make the connector 10. The first header portion 66 comprises vertical front and rear walls 66*a*, and a bottom wall 66*b* having a generally circular-arc cross section, interconnecting the lower ends of the front and rear walls 66*a* and bulging downward. The second header portion 67 comprises vertical front and rear walls 67*a*, a bottom wall 67*b* having a generally circular-arc cross section, interconnecting the lower ends of the front and rear walls 67*a* and bulging downward, and a horizontal flow dividing control wall 67*c* interconnecting the upper ends of the front and rear walls 67*a*. An upper end portion of the rear wall 66*a* of the first header portion 66 is connected to an upper end portion of the front wall 67*a* of the header portion 67 by the connecting wall 68. The outer surface of the front wall 66*a* of the first header portion 66 and the outer surface of the rear wall 67*a* of the second header portion 67 are positioned rearwardly or forwardly inwardly of the outer surface of the depending wall 56*d* of the first header portion 56 of the first member 50 and the outer surface of the depending wall 57*d* of the second header portion 57, respectively, whereby stepped portions 69 are provided at respective joints between the depending wall 56*d* of the first member 50 and the front wall 66*a* of the second member 51 and between the depending wall 57*d* of the first member 50 and the rear wall 67*a* of the second member 51, the outer surfaces of the depending walls 56*d*, 57*d* are positioned forwardly or rearwardly outwardly of the respective outer surfaces of the front wall 66*a* and the rear wall 67*a*, with the stepped portions 69 provided therebetween, and each drain groove 63 has its lower end entirely opened at the stepped portion 69 (see FIGS. 6 and 7). The outer surface of an upper edge portion of the front wall 66*a* of the first header portion 66 and the outer surface of the rear wall 67*a* of the second header portion 67 are flush with the bottom surfaces of the portions of the drain grooves 63 existing in the depending walls 56*d*, 57*d*, respectively. The outer surface of the front wall 66*a* of the first header portion 66 provides the lower portion of front side surface of the inflow header 9, and the outer surface of rear wall 67*a* of the second header portion 67 provides the lower portion of rear side surface of the outflow header 11.

The flow dividing control wall 67*c* of the second header portion 67 of the second member 51 has a plurality of circular refrigerant passing through holes 71 arranged laterally at a spacing and formed in the wall portion rearwardly of the midportion of the wall 67*c* with respect to the front-rear direction. The spacing between each adjacent pair of passing holes 71 gradually increases from the left end of the wall toward the right end thereof. This decreases the number of passing holes 71 per unit length of the wall 67*c* toward the right. Alternatively, all the holes 71 may be arranged at equal intervals. The connecting wall 68 of the second member 51 has drain through holes 72 elongated laterally and positioned in register with the drain through holes 64 of the first member 50, and is similarly provided with fixing through holes 73 positioned in register with the fixing through holes 65 of the first member 50.

The second member 51 is made by extruding the front and rear walls 66*a*, 67*a* and bottom walls 66*b*, 67*b* of the header portions 66, 67, the flow dividing control wall 67*c* of the second header portion 67 and the connecting wall 68 in the form of an integral piece, and thereafter subjecting the extrudate to press work to form refrigerant passing holes 71 in the control wall 67*c* and the drain through holes 72 and fixing through holes 73 in the connecting wall 68.

The drain assisting plate 54 has cutouts 74 extending from its upper edge and formed at portions thereof corresponding to the drain through holes 64, 72 of the first and second members 50, 51. The width of opening of each cutout 74 is equal to the lateral length of the drain through holes 64, 72. The plate 54 is provided in each of the front and rear sides thereof with drain assisting grooves 75 extending vertically from the lower ends of the respective cutouts 74 and having lower ends opened at the lower end face of the plate 54. The drain assisting plate 54 is provided on its upper edge with projections 76 projecting upward, positioned in register with the respective fixing through holes 65, 73 in the first and second members 50, 51 and insertable into the holes 65, 73.

The plate 54 is made from a bare aluminum sheet by forming the cutouts 74, drain assisting grooves 75 and projections 76 by press work.

Each of the caps 52, 53 is in the form of a plate shaped in conformity with the cross sectional shape of the contour of the combination of the first and second members 50, 51, and is made from an aluminum brazing sheet having a brazing material layer over opposite surfaces thereof by press work. The left cap 52 has a front portion integrally provided with a rightward protrusion 77 to be fitted into the inflow header 9, and a rear portion integrally provided with an upper rightward protrusion 78 to be fitted into the upper part of the outflow header 11 above the control wall 67*c* and with a lower rightward protrusion 79 positioned below and spaced apart from the protrusion 78 and to be fitted into the lower part of the header 11 under the wall 67*c*. The left cap 52 has engaging lugs 81 projecting rightward and formed on a circular-arc portion between the lower edge thereof and each of the front and rear side edges thereof and also on a portion of the upper edge thereof closer to each of the front and rear ends thereof. The left cap 52 further has engaging rugs 82 projecting leftward and formed on the midportions, with respect to the front-rear direction, of the upper and lower edges thereof. Through holes 83, 84 are formed respectively in the bottom wall of the front rightward protrusion 77 of the left cap 52 and in the bottom wall of rear lower rightward protrusion 79 of the cap. The front hole 83 causes the interior of the inflow header 9 to communicate with the outside, and the rear hole 84 causes the lower part of the outflow header 11 below the control wall 67*c* to communicate with the outside.

The right cap 53 has a front portion integrally provided with a leftward protrusion 85 fittable into the inflow header 9, and a rear portion integrally provided with an upper leftward protrusion 86 to be fitted into the upper part of the outflow header 11 above the control wall 67*c* and with a lower leftward protrusion 87 positioned below and spaced apart from the protrusion 86 and to be fitted into the lower part of the header 11 under the wall 67*c*. The right cap 53 has engaging lugs 88 projecting leftward and integrally formed on a circular-arc portion between the lower edge thereof and each of the front and rear side edges thereof and also on a portion of the upper edge thereof closer to each of the front and rear ends thereof. No through hole is formed in the rightward protrusion 85 or in the lower rightward protrusion 87.

The communication member 55 is made from a bare aluminum material by press work. When seen from the left side, the member 55 is in the form of a plate having the same size and shape as the left cap 52 and has a peripheral edge portion brazed to the outer surface of the left cap 52. The communication member 55 is provided with an outwardly bulging portion 89 for holding the two through holes 83, 84 of the left cap 52 in communication therethrough. The interior of the bulging portion 89 provides a communication channel 91 for holding the holes 83, 84 of the cap 52 in communication. The communication member 55 has cutouts 92 formed in the midportions, with respect to the front-rear direction, of the upper and lower edges thereof for the engaging lugs 82 of the left cap 52 to fit in.

The first and second members 50, 51, two caps 52, 53, drain assisting plate 54 and communication member 55 of the turn tank 3 are brazed in the manner to be described below. The connecting walls 58, 68 are fitted to each other with the drain through holes 64, 72 in register and with the fixing through holes 65, 73 in register, the lower ends of depending walls 56*d*, 57*d* of the two header portions 56, 57 are engaged with the respective upper ends of the front wall 66*a* of the first header portion 66 and the rear wall 67*a* of the second header portion 67, and the projections 76 of the drain assisting plate 54 are inserted through the fixing holes 73, 65 of the two members 50, 51 from below and secured to the members by crimping, whereby the two members are held together temporarily. In this state, the first member 50 and the second member 51 are brazed to each other utilizing the brazing material layer of the first member 50. The drain assisting plate 54 is brazed to the connecting walls 58, 68 of the two members 50, 51 utilizing the brazing material layer of the first member 50. To fix the two caps 52, 53 to the first and second members 50, 51, the front protrusions 77, 85 are fitted into the space defined by the first header portions 56, 66 of the two members 50, 51, the rear upper protrusions 78, 86 are fitted into the upper part above the control wall 67*c* within the space defined by the second header portions 57, 67 of the two members 50, 51, the rear lower protrusions 79, 87 are fitted into the lower part below the control wall 67*c* within the space defined by the second header portions 57, 67 of the two members 50, 51, the upper engaging lugs 81, 88 are engaged with the first member 50, and the lower engaging lugs 81, 88 are engaged with the second member 51. In this state, the caps 52, 53 are brazed to the first and second members 50, 51 utilizing the brazing material layer of the caps 52, 53. The communication member 55 is brazed to the left cap 53 utilizing the brazing material layer of the left cap 53, with the engaging lugs 82 on the cap 52 fitting in the cutouts 92.

In this way, the refrigerant turn tank 3 is made. The first header portions 56, 66 of the two members 50, 51 provide the inflow header 9, and the second header portions 57, 67 provide the outflow header 11. The outflow header 1 is divided by the control wall 67*c* into upper and lower two spaces 11A, 11B, which are held in communication by the circular refrigerant passing holes 71. The front through hole 83 in the left cap 52 communicates with the inflow header 9, and the rear through hole 84 of the same cap with the lower space 11B of the outflow header 11. The interior of the inflow header 9 communicates with the lower space 11B of the outflow header 11 through the holes 83, 84 of the left cap 53 and the communication channel 91 inside the outwardly bulging portion 89 of the communication member 55. The connecting walls 58, 68 of the two members 50, 51 provide the connector 10. The first low portion 9*b* of the inflow header 9, the first low portion 11*b* of the outflow header 11 and the connector 10 provide the drain gutter 20. The drain through holes 64, 72 in the connecting walls 58, 68 of the two members 50, 51 form drain holes 93 in the connector 10.

The heat exchange tubes 12 providing the front and rear tube groups 13 are each made of a bare material of aluminum extrudate. Each tube 12 is flat, has a large width in the front-rear direction and is provided in its interior with a plurality of refrigerant channels 12*a* extending longitudinally of the tube and arranged in parallel. Each heat exchange tube 12 of the front group 13 and the corresponding tube of the rear group are in the same position with respect to the left-right direction. The tubes 12 have upper end portions inserted through the slits 23 in the first member 16 of the refrigerant inlet-outlet tank 2 and are brazed to the first member 16 utilizing the brazing material layer of the member 16. The tubes 12 have lower end portions inserted through the slits 59 in the first member 50 of the refrigerant turn tank 3 and are brazed to the first member 50 utilizing the brazing material layer of the member 50. The tubes 12 of the front group 13 communicate with the inlet header 5 and the inflow header 9, and the tubes 12 of the rear group 13 with the outlet header 6 and the outflow header 11.

Preferably, the heat exchange tube 12 is 0.75 to 1.5 mm in height h, i.e., in thickness in the lateral direction (see FIG. 9), 12 to 18 mm in width in the front-rear direction, 0.175 to 0.275 mm in the wall thickness of the peripheral wall thereof, 0.175 to 0.275 mm in the thickness of partition walls separating the refrigerant channels 12*a* from one another, 0.5 to 3.0 mm in the pitch of partition walls, and 0.35 to 0.75 mm in the radius of curvature of the outer surfaces of the front and rear opposite end walls.

In place of the heat exchange tube 12 of aluminum extrudate, an electric resistance welded tube of aluminum may be used which has a plurality of refrigerant channels formed therein by inserting inner fins into the tube. Also usable is a tube made from a plate which is prepared from an aluminum brazing sheet having an aluminum brazing material layer over opposite surfaces thereof by rolling work and which comprises two flat wall forming portions joined by a connecting portion, a side wall forming portion formed on each flat wall forming portion integrally therewith and projecting from one side edge thereof opposite to the connecting portion, and a plurality of partition forming portions projecting from each flat wall forming portion integrally therewith and arranged at a spacing widthwise thereof. The tube is made by bending the plate into the shape of a hairpin at the connecting portion and brazing the side wall forming portions to each other in butting relation to form partition walls by the partition forming portions. The corrugated fins to be used in this case are those made from a bare aluminum material.

The corrugated fin 14 is made from an aluminum brazing sheet having a brazing material layer on opposite sides thereof by shaping the sheet into a wavy form. The fin comprises crest portions 14*a*, furrow portions 14*b* and flat horizontal connecting portions 14*c* each interconnecting the crest portion 14*a* and the furrow portion. The connecting portion 14*c* has a plurality of louvers (not shown) arranged in the front-rear direction. The corrugated fin 14 is used in common for the front and rear heat exchange tubes. The width of the fin 14 in the front-rear direction is approximately equal to the distance from the front edge of the heat exchange tube 12 in the front tube group 13 to the rear edge of the corresponding heat exchange tube 12 in the rear tube group 13 (see FIG. 3). The front edges of the corrugated fins 14 are projected forward beyond the front edges of the heat exchange tubes 12 of the front group 13. Instead of one corrugated fin serving for both the front and rear tube groups 13 in common, a corrugated fin may be provided between each adjacent pair of heat exchange tubes 12 of each tube group 13.

It is desired that the corrugated fin 14 be 7.0 mm to 10.0 mm in fin height H which is the straight distance from the crest portion 14*a* to the furrow portion 14*b*, and 1.3 to 1.7 mm in fin pitch P which is the pitch of connecting portions 14*c*. While the crest portion 14*a* and the furrow portion 14*b* of the corrugated fin 14 each comprise a flat portion brazed to the heat exchange tube 12 in intimate contact therewith, and a rounded portion provided at each of opposite sides of the flat portion and integral with the connecting portion 14*c*, the radius R of curvature of the rounded portion is preferably up to 0.7 mm.

The evaporator 1 is fabricated by tacking the components in combination and brazing all the components collectively.

Along with a compressor and a condenser, the evaporator 1 constitutes a refrigeration cycle wherein chlorofluorocarbon refrigerant is used, and the cycle is installed in vehicles, for example, in motor vehicles for use as an air conditioner.

With reference to FIG. 11 showing the evaporator 1 described, a two-layer refrigerant of vapor-liquid mixture phase flowing through a compressor, condenser and expansion valve enters the refrigerant inlet header 5 of the inlet-outlet tank 2 via the refrigerant inlet pipe 7, the refrigerant inlet portion 45 of the joint plate 21 and the refrigerant inlet 37 of the right cap 19 and dividedly flows into the refrigerant channels 12*a* of all the heat exchange tubes 12 of the front tube group 13.

The refrigerant flowing into the channels 12*a* of all the heat exchange tubes 12 flows down the channels 12*a*, ingresses into the refrigerant inflow header 9 of the refrigerant turn tank 3. The refrigerant in the header 9 flows leftward, further flows through the front through hole 83 of the left cap 52, the communication channel 91 inside the outwardly bulging portion 89 of the communication member 55 and the rear through hole 84 of the left cap 52, thereby changing its course to turn, and enters the lower space 11B of the outflow header 11.

Even if the refrigerant fails to dividedly flow into the heat exchange tubes 12 of the front group 13 fully uniformly and consequently becomes uneven in the distribution of temperatures (qualities of wet vapor) while flowing through the tubes 12 of the front group 13, the refrigerant is agitated and becomes uniform in temperature in its entirety when flowing from the inflow header 9 into the lower space 11B of the outflow header 11 upon turning.

The refrigerant entering the lower space 11B of the outflow header 11 flows rightward, flows into the upper space 11A through the refrigerant passing circular holes 71 in the flow dividing control wall 67*c* within the outflow header 11 and dividedly flows into the refrigerant channels 12*a* of all the heat exchange tubes 12 of the rear group 13.

The refrigerant entering the refrigerant channels 12*a* of the tubes 12 flows up the channels 12*a* upon changing its course, flows into the lower space 6*b* of the outlet header 6 and then flows into the upper space 6*a* through the refrigerant passing oblong holes 31A, 31B in the flow dividing resistance plate 29. Since the resistance plate 29 offers resistance to the flow of refrigerant, the divided flows from the upper space 11*a* of the outflow header 11 into all the tubes 12 of the rear group 13 are made uniform, also permitting the refrigerant to flow from the lower space 5*b* of the inlet header 5 dividedly into all the tubes 12 of the front group 13 also uniformly. As a result, the refrigerant flows through all tubes 12 of the two groups 13 uniformly to give a uniform temperature distribution to the entire heat exchange core 4.

The refrigerant flowing into the upper space 6*a* of the outlet header 6 thereafter flows out of the evaporator via the refrigerant outlet 38 of the right cap 19, the outlet portion 46 of the joint plate 21 and the outlet pipe 8. While flowing through the refrigerant channels 12*a* of the heat exchange tubes 12 of the front tube group 13 and the refrigerant channels 12*a* of the heat exchange tubes 12 of the rear tube group 13, the refrigerant is subjected to heat exchange with the air flowing through the air passing clearances in the direction of arrow X shown in FIGS. 1 and 11 and flows out of the evaporator in a vapor phase.

At this time, water condensate is produced on the surfaces of the corrugated fins 14. The condensation water flows down onto the inflow header 9 and the outflow header 11 of the turn tank 3. The condensation water flowing down the rear end faces of the heat exchange tubes 12 of the front group 13 and the front end faces of the tubes 12 of the rear group 13 directly enters the drain gutter 20 and flows down the front and rear side faces of the gutter 20 onto the connector 10 serving as the bottom of the gutter 20. When collecting inside the gutter in an amount, the condensation water flows through the drain holes 93 to below the connector 10, flows along peripheral edges of the cutouts 74 in the drain assisting plate 54 into drain assisting grooves 75, further flows down the grooves 75 and falls to below the turn tank 3 from the lower-end openings of the grooves 75.

On the other hand, the portion of condensation water flowing down the front end faces of the tubes 12 of the front group 13 and the rear end faces of the tubes 12 of the rear group 13 flows directly into the drain grooves 63, flows through the grooves 63 and falls to below the turn tank 3 from the lower-end openings of the grooves 63 at the stepped portions 69.

Further the portion of condensation water flowing onto the horizontal flat surfaces 9*a*, 11*a* of the inflow header 9 and the outflow header 11 of the turn tank 3 enters the recesses 62 defined by the left and right side slanting portions 61 of the tube insertion slits 59 by virtue of a capillary effect, flows directly into the drain gutter 20 from the forwardly or rearwardly inner ends of the recesses 62, flows along the front and rear side faces of the gutter 20 onto the connector 10 serving as the bottom of the gutter 20 and thereafter falls to below the turn tank 3 in the same manner as above. Further the condensation water flowing into the recesses 62 enters the drain grooves 63 from the forwardly or rearwardly outer ends of the recesses 62, flows through the grooves 63 and fall to below the turn tank 3 from lower-end openings thereof. The condensation water not entering the recesses 62 is entrained by the air flowing through the air passage clearances between the respective adjacent pairs of heat exchange tubes 12 to flow downstream with respect to the direction of flow of the air, i.e., toward the front side of the evaporator, overcoming the surface tension of the water acting to remain on the horizontal flat surfaces 9*a*, 11*a*. The condensation water on the horizontal flat surface 9*a* of the inflow header 9 flows along the second low portion 9*c* and falls to below the turn tank 3. The outer surface of the depending wall 56*d* of the first member 50 is positioned forwardly outwardly of the outer surface of the front wall 66*a* of the second member 51, and the stepped portion 69 between the two outer surfaces acts to drain the tank of the water, permitting the water to fall to below the turn tank 3 effectively. On the other hand, the condensation water on the horizontal flat surface 11*a* of the outflow header 11 flows along the first low portion 11*b* into the drain gutter 20 and falls to below the turn tank 3 in the same manner as above. In this way, a large quantity of condensation water is prevented from collecting between the horizontal flat surfaces 9*a*, 11*a* of the headers 9, 11 of the turn tank 3 and the lower ends of the corrugated fins 14 and therefore from freezing although the water would freeze if collecting in a large amount, whereby inefficient performance of the evaporator 1 is precluded.

Although the heat exchanger of the present invention is used as the evaporator of a motor vehicle air conditioner wherein a chlorofluorocarbon refrigerant is used according to the embodiment described, such a use is not limitative. The heat exchanger of the invention may be used in vehicles as an evaporator in a motor vehicle air conditioner wherein $CO_2$ refrigerant is used and which comprises a compressor, gas cooler, intermediate heat exchanger, expansion valve and evaporator.

Further according to the above embodiment, the inflow header 9 of the turn tank 3 communicates with the lower space 11B of the outflow header 11 at the end portion opposite to the refrigerant inlet 37 of the inlet header 5, but may communicate therewith conversely at the same end as the inlet 37.

INDUSTRIAL APPLICABILITY

The heat exchanger of the invention is suitable for use as an evaporator in motor vehicle air conditioners which are motor vehicle refrigeration cycles.

The invention claimed is:

1. A heat exchanger comprising:

a heat exchange core having tube groups in the form of a plurality of rows arranged in parallel in a front-rear direction each group comprising a plurality of heat exchange tubes arranged in a row along a left-right direction at a spacing; and a lower tank disposed at the lower end of the heat exchange core, the lower tank having a plurality of headers arranged in the front-rear direction and having joined thereto the respective groups of the heat exchange tubes, wherein:

the heat exchange tubes of each tube group being joined to each of the headers while being inserted through respective tube insertion holes formed in a top wall of the header, the headers adjacent to each other being connected to each other by a connector, the adjacent headers and the connector providing a drain gutter extending in the left-right direction, the drain gutter having front and rear opposite side faces extending respectively forwardly and rearwardly outward away from each other as the side faces extend upward, each of the tube insertion holes having one end adjacent to the connector and positioned in the side face of the drain gutter, each of the heat exchange tubes having a side end adjacent to the connector and positioned in the drain gutter, and the headers positioned respectively at forwardly and rearwardly outer end portions of the lower tank are provided in forwardly and rearwardly outer side portions of top surfaces thereof with drain grooves extending from the respective tube insertion holes for discharging condensation water to below the lower tank therethrough.

2. A heat exchanger according to claim 1 wherein the connector has a drain hole extending therethrough.

3. A heat exchanger according to claim 1 wherein the front and rear side faces of the drain gutter of the lower tank are inclined downward toward the connector with respect to a horizontal plane.

4. A heat exchanger according to claim 3 wherein the front and rear side faces of the gutter have an angle of downward inclination of at least 45 degrees.

5. A heat exchanger according to claim 1 wherein a top surface of each header of the lower tank has a horizontal flat portion continuous with the front or rear side face of the drain gutter.

6. A heat exchanger according to claim 1 wherein the drain grooves each have a bottom inclined gradually downward as the groove extends away from the tube insertion hole.

7. A heat exchanger according to claim 1 wherein the headers positioned respectively at the forwardly and rearwardly outer end portions of the lower tank have low portions provided respectively at the forwardly and rearwardly outer side portions of the top surfaces thereof and extending gradually downward as the low portions extend respectively forwardly and rearwardly outward.

8. A heat exchanger according to claim 7 wherein the low portions are inclined downward with respect to a horizontal plane while extending respectively forwardly and rearwardly outward.

9. A heat exchanger according to claim 8 wherein the low portions are at least 45 degrees in the angle of downward inclination with respect to the horizontal plane.

10. A heat exchanger according to claim 7 wherein the drain grooves each extend from the low portion of the header top surface to forwardly or rearwardly outer side surface of the header.

11. A heat exchanger according to claim 7 wherein a bottom of each of the drain grooves has a portion existing in the low portion of the header top surface and inclined downward with respect to a horizontal plane as the bottom portion extends forwardly or rearwardly outward.

12. A heat exchanger according to claim 11 wherein the bottom portion of the drain groove existing in the low portion of the header top surface is at least 45 degrees in the angle of downward inclination with respect to the horizontal plane.

13. A heat exchanger according to claim 1 wherein each drain groove extends from the forwardly or rearwardly outer end of each tube insertion hole to an intermediate portion of the height of the corresponding forwardly or rearwardly outer side surface of the header, and the portion of the forwardly or rearwardly outer side surface of the header where the drain groove is formed is positioned forwardly or rearwardly outwardly of a header side portion lower than the outer side surface portion, with a stepped portion formed therebetween, the drain groove having a lower end opened at the stepped portion.

14. A heat exchanger according to claim 1 wherein the lower tank comprises a first member having the heat exchange tubes joined thereto, and a second member joined to the first member at a portion thereof opposite to the heat exchange tubes, each of the first member and the second member comprising a plurality of header portions arranged in the front-rear direction and a connecting wall interconnecting the header portions adjacent to each other, the two members being joined to each other at front and rear side edges thereof and at the connecting walls thereof, the header portions of the two members providing the headers, the connecting walls providing the connector.

15. A heat exchanger according to claim 14 wherein a stepped portion is provided at each of joints between the first member and the second member at the front and rear side edges thereof, whereby front and rear side surfaces of the header portions at forwardly and rearwardly outer ends of the first member are positioned respectively forwardly and rearwardly outwardly of respective front and rear side surfaces of the header portions at forwardly and rearwardly outer ends of the second member, with the respective stepped portions provided therebetween.

16. A heat exchanger according to claim 1 wherein left and right opposite side portions of each tube insertion hole in a top surface of the lower tank are inclined downward toward the tube insertion hole.

17. A heat exchanger according to claim 1 wherein the heat exchange tubes are flat and have their width positioned in the front-rear direction and are 0.75 to 1.5 mm in tube height which is the thickness thereof.

18. A heat exchanger according to claim 1 wherein fins are arranged between respective adjacent pairs of heat exchange tubes and are each a corrugated fin comprising crest portions, furrow portions and flat connecting portions interconnecting the crest portions and the furrow portions, the fins being 7.0 mm to 10.0 mm in height which is the straight distance from the crest portion to the furrow portion, and 1.3 to 1.7 mm in fin pitch which is the pitch of connecting portions.

19. A heat exchanger according to claim 18 wherein the crest portion and the furrow portion of the fin each comprise a flat portion, and a rounded portion provided at each of opposite sides of the flat portion and integral with the connecting portion, the rounded portion being up to 0.7 mm in radius of curvature.

20. A heat exchanger according to claim 1 which comprises a refrigerant inlet header disposed toward the upper ends of the heat exchange tubes and on a front side and having joined thereto at least one row of heat exchange tubes, a refrigerant outlet header disposed toward the upper ends of the heat exchange tubes and in the rear of the inlet header and having joined thereto at least one row of heat exchange tubes, and a lower tank having two headers.

21. A refrigeration cycle comprising a compressor, condenser and an evaporator, the evaporator comprising a heat exchanger according to claim 1.

22. A vehicle having installed therein a refrigeration cycle according to claim 21 as a motor vehicle air conditioner.

* * * * *